US011219807B2

(12) United States Patent
Johnson

(10) Patent No.: US 11,219,807 B2
(45) Date of Patent: Jan. 11, 2022

(54) SPORTS TRAINING ASSEMBLY

(71) Applicant: Thomas Johnson, West Bloomfield, MI (US)

(72) Inventor: Thomas Johnson, West Bloomfield, MI (US)

( * ) Notice: Subject to any disclaimer, the term of this patent is extended or adjusted under 35 U.S.C. 154(b) by 25 days.

(21) Appl. No.: 16/802,211

(22) Filed: Feb. 26, 2020

(65) Prior Publication Data

US 2021/0260454 A1 Aug. 26, 2021

(51) Int. Cl.
*A63B 63/00* (2006.01)

(52) U.S. Cl.
CPC ..... *A63B 63/00* (2013.01); *A63B 2225/50* (2013.01)

(58) Field of Classification Search
CPC ..... A63B 63/00; A63B 63/06; A63B 69/0053; A63B 69/005; A63B 2225/50; A61B 5/162
See application file for complete search history.

(56) References Cited

U.S. PATENT DOCUMENTS 4,027,875 A * 6/1977 Hurley ..... A63B 69/0053 482/8
4,029,315 A 6/1977 Bon
4,627,620 A * 12/1986 Yang ..... A63B 69/0028 273/446
5,271,627 A * 12/1993 Russell ..... A63B 69/0053 273/440
7,850,514 B2 12/2010 Weber
7,951,045 B1 * 5/2011 Brader ..... A63B 24/0062 482/3
D679,766 S 4/2013 Piot
8,771,073 B2 * 7/2014 Klinnert ..... G08C 17/02 463/36
8,911,308 B2 12/2014 Daniels
2007/0213126 A1 * 9/2007 Deutsch ..... A63B 71/0686 463/36
2008/0189447 A1 8/2008 Hoch
2009/0197708 A1 * 8/2009 Fuccillo ..... A63B 69/0024 473/446
2013/0266918 A1 * 10/2013 Tinjust ..... G09B 19/00 434/247
2015/0065273 A1 * 3/2015 Lake ..... A63B 69/0053 473/422
2016/0030825 A1 * 2/2016 Mazzanobile ..... A63B 69/0028 434/255
2017/0197128 A1 * 7/2017 Peterson ..... A63B 67/02
(Continued)

*Primary Examiner* — Raleigh W Chiu

(57) ABSTRACT

A sports training assembly includes a plurality of remote targets. Each of the remote targets is positionable on a training field and each of the remote targets respectively emits a visual alert when the respective remote target is turned on. In this way the respective remote target is established as the desired target for the athlete to strike. A base target is positionable on the training field and the base target emits a visual alert when the base target is turned on thereby establishing the base target as the desired target for the athlete to strike. Moreover, the base target is in electrical communication with each of the remote targets and the base target turns on each of the remote targets in a random sequence. A plurality of balls is provided and each of the base and remote targets is mounted on a respective one of the balls. Moreover, each of the balls is biased to vertically orient the remote and base targets for striking.

7 Claims, 6 Drawing Sheets

(56) References Cited

U.S. PATENT DOCUMENTS

| | | | | |
|---|---|---|---|---|
| 2020/0051456 | A1* | 2/2020 | Connell | G09B 9/003 |
| 2020/0179788 | A1* | 6/2020 | Mazloompour | A63B 71/03 |
| 2020/0330840 | A1* | 10/2020 | Francis | A63B 63/08 |
| 2020/0384341 | A1* | 12/2020 | Peterson | A63B 63/00 |

* cited by examiner

SPORTS TRAINING ASSEMBLY

CROSS-REFERENCE TO RELATED APPLICATIONS

Statement Regarding Federally Sponsored Research or

Development
Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to training devices and more particularly pertains to a new training device having a plurality of randomly illuminated targets for striking.

BRIEF SUMMARY OF THE INVENTION

An embodiment of the disclosure meets the needs presented above by generally comprising a plurality of remote targets. Each of the remote targets is positionable on a training field and each of the remote targets respectively emits a visual alert when the respective remote target is turned on. In this way the respective remote target is established as the desired target for the athlete to strike. A base target is positionable on the training field and the base target emits a visual alert when the base target is turned on thereby establishing the base target as the desired target for the athlete to strike. Moreover, the base target is in electrical communication with each of the remote targets and the base target turns on each of the remote targets in a random sequence. A plurality of balls is provided and each of the base and remote targets is mounted on a respective one of the balls. Moreover, each of the balls is biased to vertically orient the remote and base targets for striking.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
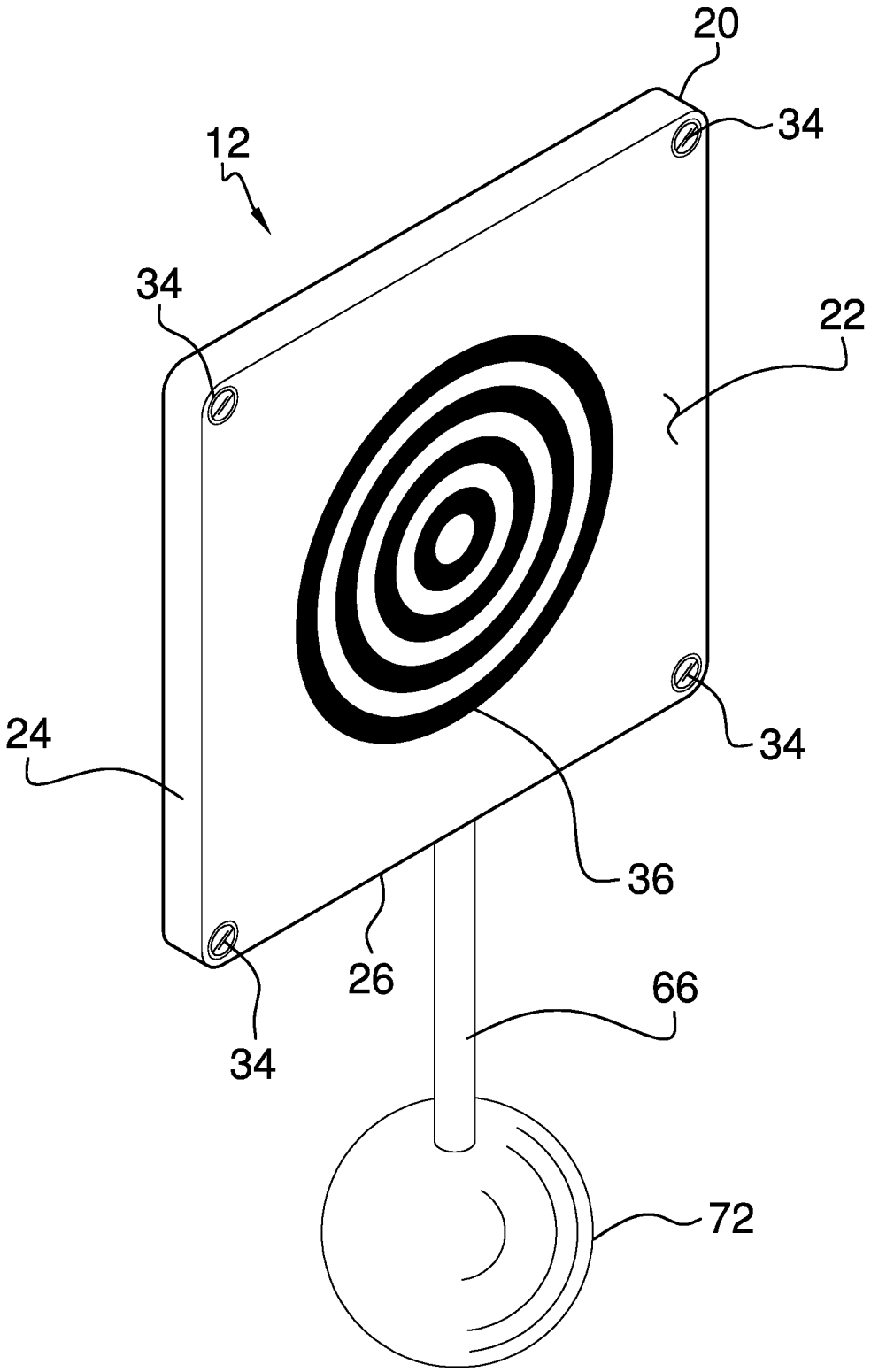
FIG. 1 is a front perspective view of a remote target of a sports training assembly according to an embodiment of the disclosure.
Figure 2:
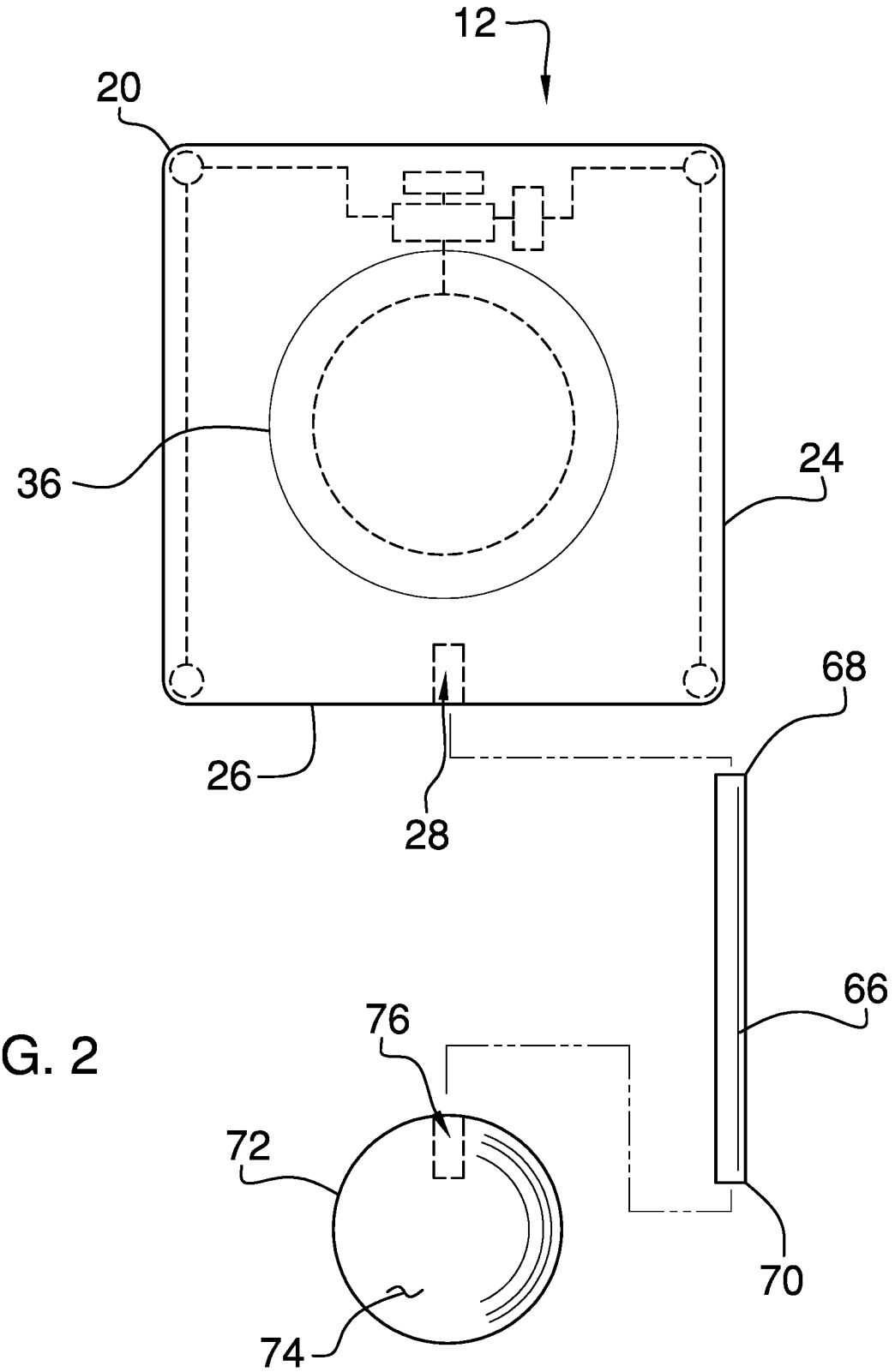
FIG. 2 is a back phantom view of remote target of an embodiment of the disclosure.
Figure 3:
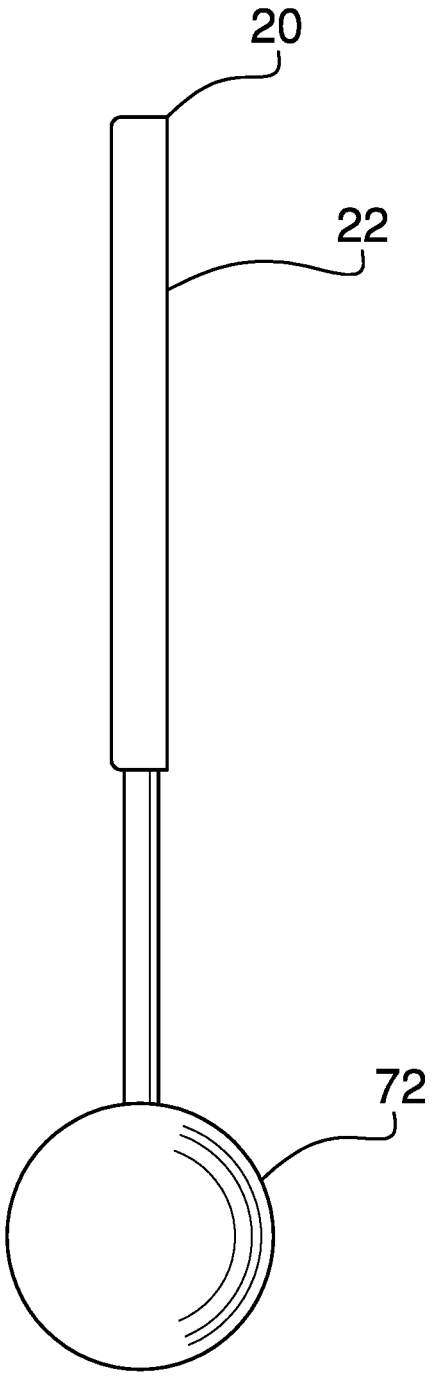
FIG. 3 is a right side view of remote target of an embodiment of the disclosure.
Figure 4:
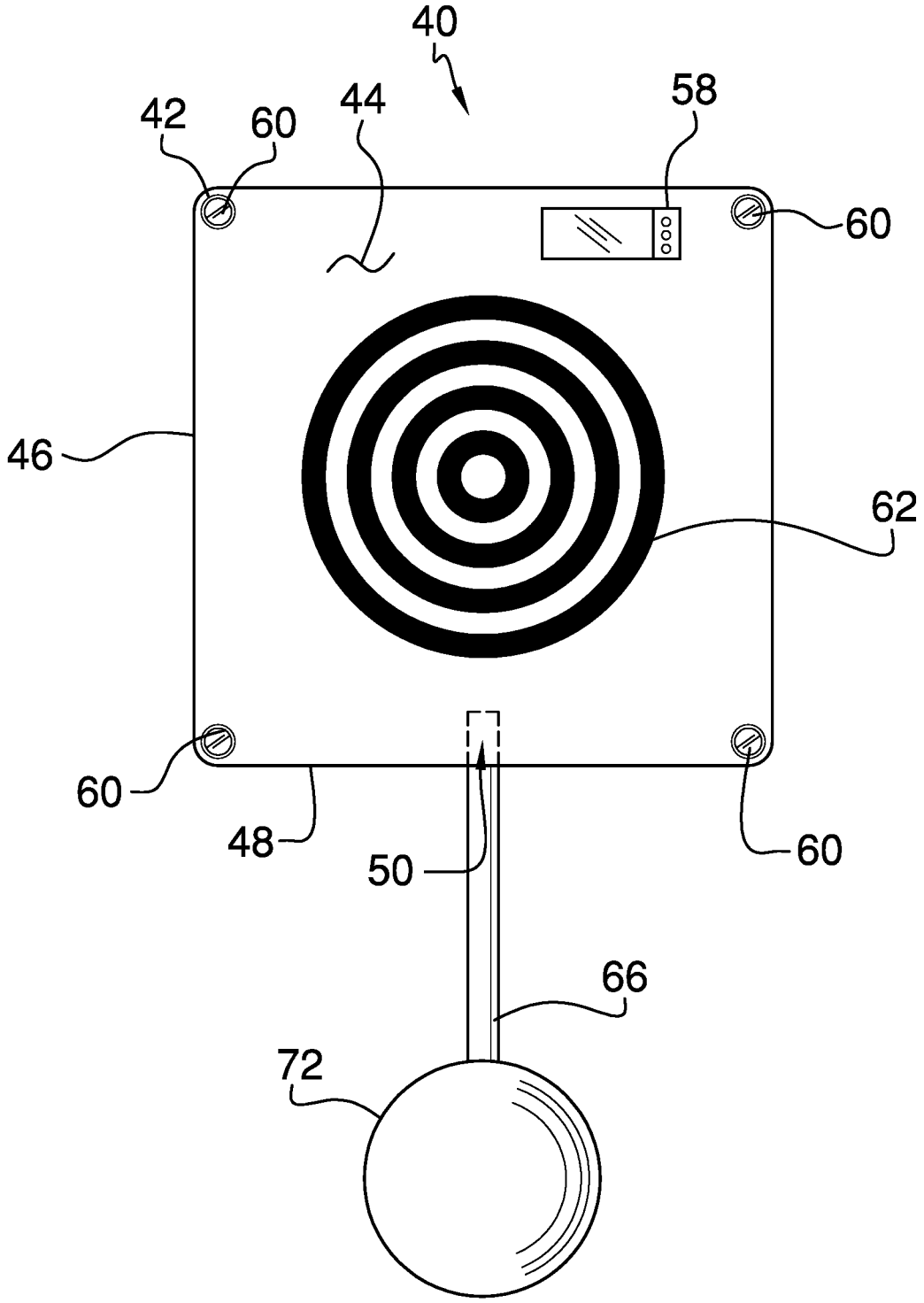
FIG. 4 is a front view of base target of an embodiment of the disclosure.
Figure 5:
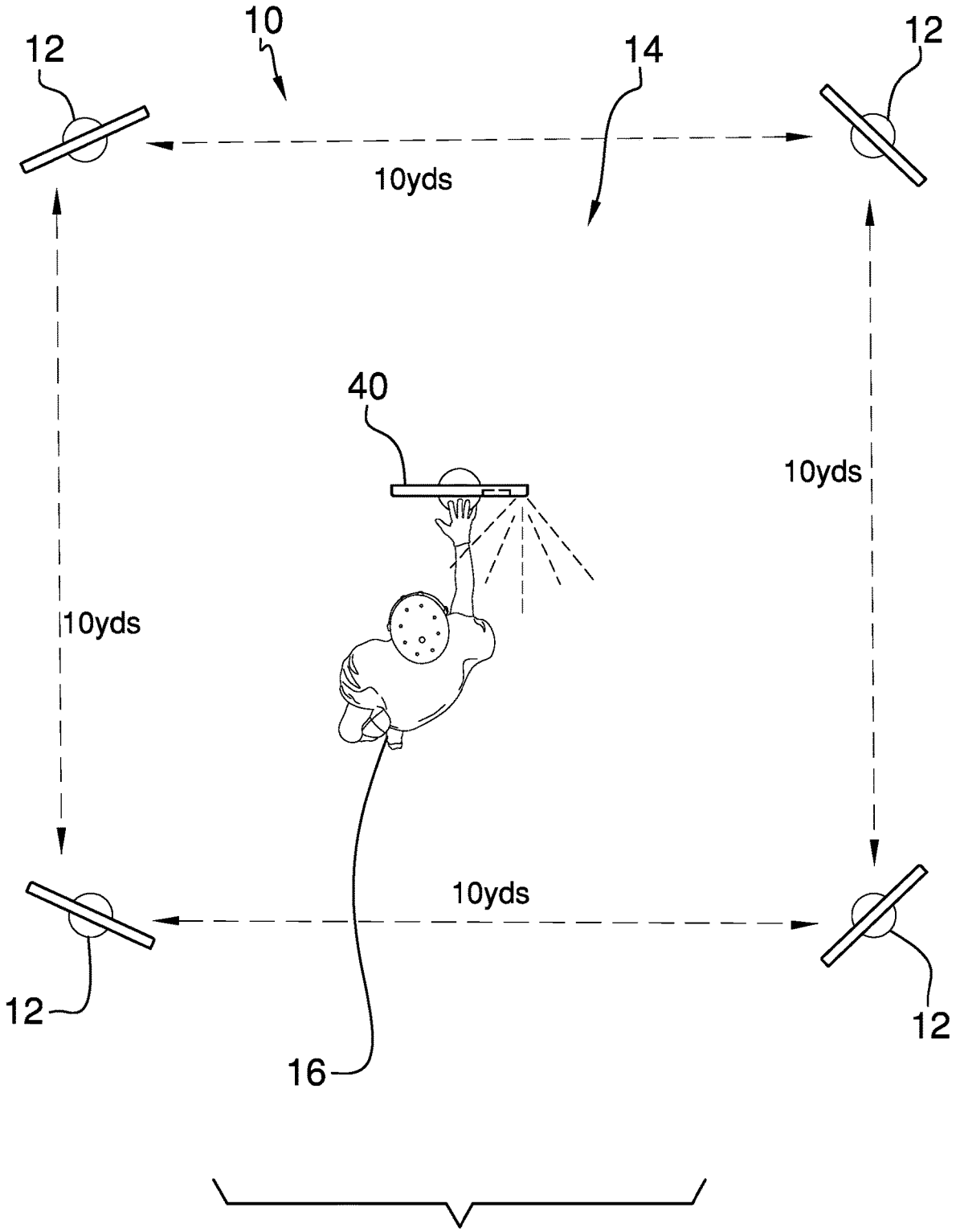
FIG. 5 is a perspective in-use view of an embodiment of the disclosure.
Figure 6:
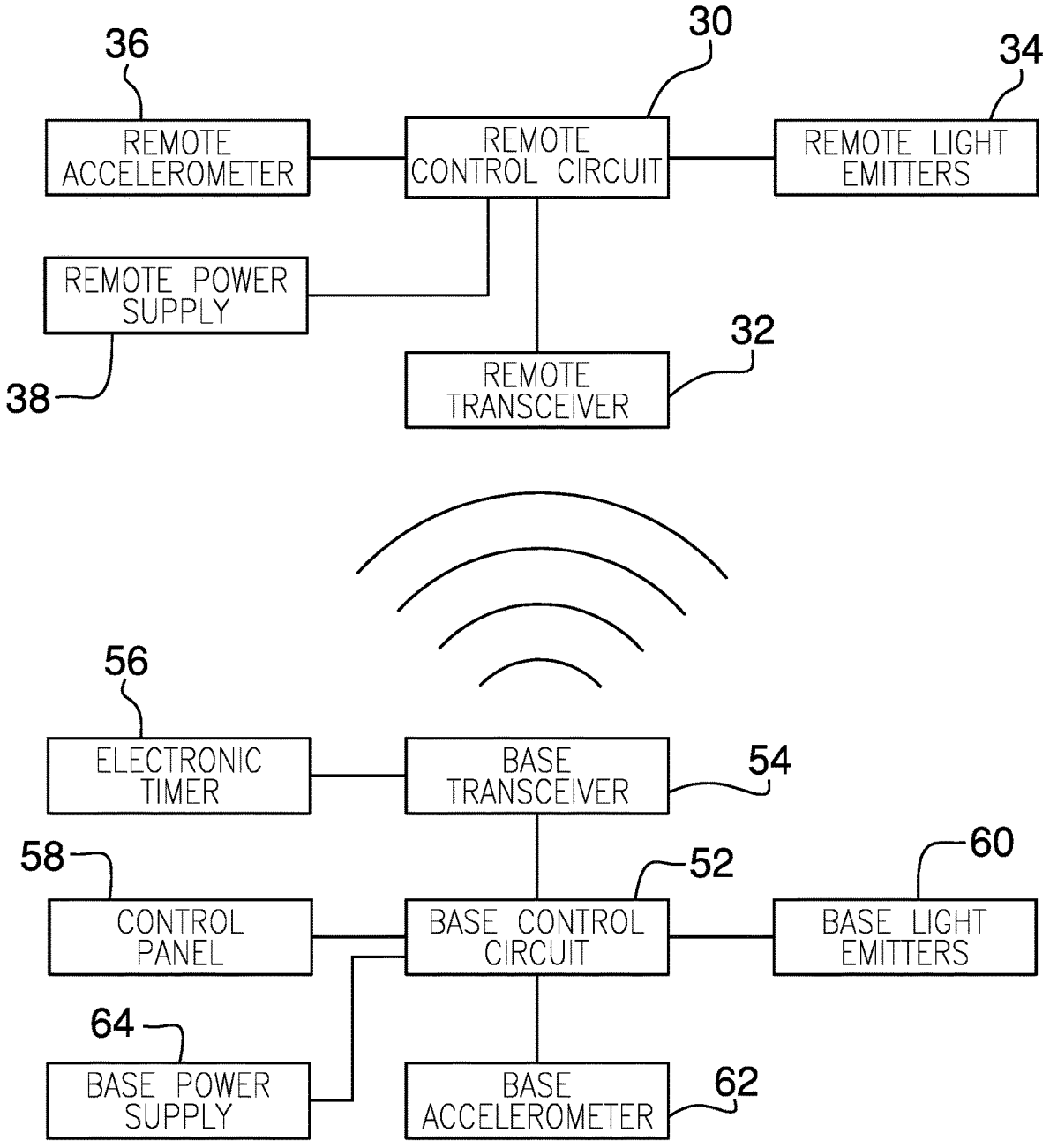
FIG. 6 is a schematic view of an embodiment of the disclosure.

With reference now to the drawings, and in particular to FIGS. 1 through 6 thereof, a new training device embodying the principles and concepts of an embodiment of the disclosure and generally designated by the reference numeral 10 will be described.

As best illustrated in FIGS. 1 through 6, the sports training assembly 10 generally comprises a plurality of remote targets 12. Each of the remote targets 12 is positionable on a training field 14 for being struck by an athlete 16 during athletic training. The plurality of remote targets 12 is spaced a pre-determined distance away from each other on the training field 14. Moreover, the remote targets 12 may be arranged to define a square that has sides of approximately 10.0 yards in length. Each of the remote targets 12 respectively emits a visual alert when the respective remote target 12 is turned on. In this way the respective remote target 12 is established as the desired target for the athlete 16 to strike.

Each of the remote targets 12 comprises a remote panel 20 that has a primary surface 22 and an outer edge 24. The outer edge 24 has a lower side 26 and the lower side 26 has a well 28 extending upwardly therein. A remote control circuit 30 is positioned within the remote panel 20 and the remote control circuit 30 in each of the remote targets 12 has a unique identification with respect to each other. A remote transceiver 32 is positioned within the remote panel 20, the remote transceiver 32 is electrically coupled to the remote control circuit 30 and the remote transceiver 32 emits a trigger signal when the remote control circuit 30 receives a trigger input. Moreover, the remote control circuit 30 is turned on when the remote transceiver 32 receives an activation signal. The remote transceiver 32 may be a radio frequency transceiver with an operational range of approximately 100.0 feet.

A plurality of remote light emitters 34 is each coupled to the primary surface 22 of the remote panel 20 and each of the remote light emitters 34 is electrically coupled to the remote control circuit 30. Each of the remote light emitters 34 is turned on when the remote control circuit 30 receives the activation signal from the remote transceiver 32. In this way the remote light emitters 34 visually alert the athlete 16 to strike the remote panel 20. Each of the remote light emitters 34 may comprise an LED or other electronic light emitter.

A remote accelerometer 36 is coupled to the primary surface 22 of the remote panel 20 and the remote accelerometer 36 detects acceleration of the remote panel 20. In this way the remote accelerometer 36 detects when the athlete 16 strikes the remote panel 20. The remote control circuit 30 receives the trigger signal when the remote accelerometer 36 detects acceleration. The remote accelerometer 36 may be an electronic accelerometer of any conventional design. A remote power supply 38 is coupled to the remote target, the remote power supply 38 is electrically coupled to the remote control circuit 30 and the remote power supply 38 comprises at least one battery.

A base target 40 is provided and the base target 40 is positionable on the training field 14 wherein the base target 40 is configured to be struck by the athlete 16. The base target 40 emits a visual alert when the base target 40 is turned on thereby establishing the base target 40 as the desired target for the athlete 16 to strike. The base target 40 is in electrical communication with each of the remote targets 12 and the base target 40 turns on each of the remote targets 12 in a random sequence. The base target 40 may be positioned in a center of the square defined by the remote targets 12.

The base target 40 comprises a base panel 42 that has a first surface 44 and a peripheral edge 46. The peripheral edge 46 has a bottom side 48 and the bottom side 48 has a well 50 extending upwardly therein. A base control circuit 52 is positioned within the base panel 42 and a base transceiver 54 is positioned within the base panel 42. The base control circuit 52 stores the identification of the remote control circuit 30 in each of the remote targets 12. The base transceiver 54 is electrically coupled to the base control circuit 52 and the base transceiver 54 is in wireless electrical communication with the remote transceiver 32 in each of the remote targets 12. The base panel 42 and the remote panel 20 may each have a height and a width ranging between approximately 16.0 inches and 24.0 inches.

The base transceiver 54 emits the activation signal to the remote transceiver 32 in a randomly selected remote target thereby turning on the remote control circuit 30 in the randomly selected remote target. The base transceiver 54 receives the trigger signal from the remote transceiver 32 in the randomly selected remote target when the remote accelerometer 36 in the randomly selected remote target detects acceleration. Moreover, the base control circuit 52 randomly selects a subsequent remote target when the base transceiver 54 receives the trigger signal. The base transceiver 54 may be a radio frequency transceiver with an operational range of approximately 100.0 feet.

An electronic timer 56 is positioned within the base panel 42 and the electronic timer 56 is electrically coupled to the base control circuit 52. The base transceiver 54 emits the activation signal after the electronic timer 56 counts a pre-determined amount of time. A control panel 58 is coupled to the first surface 44 of the base panel 42 and the control panel 58 is electrically coupled to the control circuit. The control panel 58 is manipulated to select one of a plurality of pre-determined trigger times in the electronic timer 56. The control panel 58 may include a touch screen, a plurality of buttons or any other electronic control system.

A plurality of base light emitters 60 is each coupled to the first surface 44 of the base panel 42 and each of the base light emitters 60 is electrically coupled to the base control circuit 52. Each of the base light emitters 60 is turned on when the base control circuit 52 randomly selects the base target 40 to be turned. In this way the base light emitters 60 visually alert the athlete 16 to strike the base panel 42. Each of the base light emitters 60 may be an LED or other electronic light emitter.

A base accelerometer 62 is coupled to the first surface 44 of the base panel 42 and the base accelerometer 62 is electrically coupled to the base control circuit 52. The base accelerometer 62 detects acceleration of the base panel 42 thereby detecting when the athlete 16 strikes the base panel 42. Moreover, the base control circuit 52 receives a strike input when the base accelerometer 62 detects acceleration. The base control circuit 52 randomly selects a subsequent remote target 12 when the base control circuit 52 receives the strike signal. The base accelerometer 62 may be an electronic accelerometer of any conventional design. A base power supply 64 is coupled to the base panel 42, the base power supply 64 is electrically coupled to the base control circuit 52 and the base power supply 64 comprises at least one battery.

A plurality of poles 66 is provided and each of the poles 66 has a respective one of the remote 12 or base 40 targets is removably coupled thereto. Each of the poles 66 has a first end 68 and a second end 70, and the well 28 in each of the remote 12 and base 40 targets insertably receives the first end 68 of a respective one of the poles 66. Each of the poles 66 may have a length ranging between approximately 12.0 inches and 24.0 inches. A plurality of balls 72 is provided and each of the balls 72 is internally weighted off center. Thus, each of the balls 72 is biased to return to a home position when the balls 72 are rolled. Each of the balls 72 has a respective one of the poles 66 removably coupled thereto and each of the balls 72 vertically orients the respective pole when the balls 72 are in the home position. In this way the remote 12 and base 40 targets are elevated above the training field 14 for striking. Each of the balls 72 has an outer surface 74 and the outer surface 74 of each of the balls 72 has a well 76 extending inwardly therein. The well 76 in each of the balls 72 is directed upwardly when the balls 72 are in the home position and the well 76 in the outer surface 74 of each of the balls 72 insertably receives the second end 70 of the respective pole 66. Additionally, each of the balls 72 may have a diameter ranging between approximately 10.0 inches and 14.0 inches.

In use, each of the balls 72 is positioned on the training field 14 to define the square. Each of the poles 66 is inserted into a respective one of the balls 72 and each of the base 40 and remote targets 12 are positioned on a respective one of the poles 66. The control panel 58 is manipulated to select the pre-determined duration of time for the electronic timer 56 to count. The base control circuit 52 randomly selects the identification of one of the remote targets 12 or the base target 40. Thus, the remote light emitters 34 on the randomly selected remote target 12 or the base light emitters 60 are turned on and the athlete 16 runs toward the randomly selected remote target to strike the randomly selected remote target 12 or the base target 40. The base control circuit 52 receives the trigger signal when the randomly selected remote target 12 is struck, the electronic timer 56 counts down the pre-determined duration of time and the base control circuit 52 repeats the process of randomly selecting the identification of one of the remote targets 12 or the base target 40. In this way the athlete 16 must continually run toward and strike the illuminated base 40 or remote target 12 for athletic training purposes.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sports training assembly having a plurality of sequentially illuminated targets for enhancing physical speed and reaction time, said assembly comprising:

a plurality of remote targets, each of said remote targets being positionable on a training field wherein each of said remote targets is configured to be struck by an athlete, said plurality of remote targets being spaced a pre-determined distance away from each other on the training field, each of said remote targets respectively emitting a visual alert when said respective remote target is turned on thereby establishing said respective remote target as the desired target for the athlete to strike;

a base target being positionable on the training field wherein said base target is configured to be struck by the athlete, said base target emitting a visual alert when said base target is turned on thereby establishing said base target as the desired target for the athlete to strike, said base target being in electrical communication with each of said remote targets, said base target turning on each of said remote targets in a random sequence;

a plurality of poles, each of said poles having a respective one of said remote or base targets being removably coupled thereto; and a plurality of balls, each of said balls being internally weighted off center such that each of said balls is biased to return to a home position when said balls are rolled, each of said balls having a respective one of said poles being removably coupled thereto, each of said balls vertically orienting said respective pole when said balls are in said home position thereby elevating said remote and base targets for striking; and wherein each of said remote targets comprises:

a remote panel having a primary surface and an outer edge, said outer edge having a lower side, said lower side having a well extending upwardly therein;

a remote control circuit being positioned within said remote panel;

a remote transceiver being positioned within said remote panel, said remote transceiver being electrically coupled to said remote control circuit, said remote transceiver emitting a trigger signal when said remote control circuit receives a trigger input, said remote control circuit being turned on when said remote transceiver receives an activation signal; and a plurality of remote light emitters, each of said remote light emitters being coupled to said primary surface of said remote panel, each of said remote light emitters being electrically coupled to said remote control circuit, each of said remote light emitters being turned on when said remote control circuit receives said activation signal from said remote transceiver wherein said remote light emitters are configured to visually alert the athlete to strike said remote panel.

2. The assembly according to claim 1, further comprising:

a remote accelerometer being coupled to said first surface of said remote panel, said remote accelerometer detecting acceleration of said remote panel wherein said remote accelerometer is configured to detect when the athlete strikes said remote panel, said remote control circuit receiving said trigger signal when said remote accelerometer detects acceleration; and a remote power supply being coupled to said remote target, said remote power supply being electrically coupled to said remote control circuit, said remote power supply comprising at least one battery.

3. The assembly according to claim 1, wherein said base target comprising:

a base panel having a first surface and a peripheral edge, said peripheral edge having a bottom side, said bottom side having a well extending upwardly therein;

a base control circuit being positioned within said base panel; and a base transceiver being positioned within said base panel, said base transceiver being electrically coupled to said base control circuit, said base transceiver being in wireless electrical communication with said remote transceiver in each of said remote targets, said base transceiver emitting said activation signal to said remote transceiver in a randomly selected remote target thereby turning on said remote control circuit in said randomly selected remote target, said base transceiver receiving said trigger signal from said remote transceiver in said randomly selected remote target when said remote accelerometer in said randomly selected remote target detects acceleration, said base control circuit randomly selecting a subsequent remote target when said base transceiver receives said trigger signal.

4. The assembly according to claim 3, further comprising:

an electronic timer being positioned within said base panel, said electronic timer being electrically coupled to said base control circuit, said base transceiver emitting said activation signal after said electronic timer counts a pre-determined amount of time;

a control panel being coupled to said first surface of said base panel, said control panel being electrically coupled to said control circuit, said control panel being manipulated to select one of a plurality of pre-determined trigger times in said electronic timer; and a plurality of base light emitters, each of said base light emitters being coupled to said first surface of said base panel, each of said light emitters being electrically coupled to said base control circuit, each of said base light emitters being turned on when said base control circuit randomly selects said base target to be turned on wherein said base light emitters are configured to visually alert the athlete to strike said base panel.

5. The assembly according to claim 4, further comprising:

a base accelerometer being coupled to said first surface of said base panel, said base accelerometer being electrically coupled to said base control circuit, said base accelerometer detecting acceleration of said base panel wherein said base accelerometer is configured to detect when the athlete strikes said base panel, said base control circuit receiving a strike input when said base accelerometer detects acceleration, said base control circuit randomly selecting a subsequent remote target when said base control circuit receives said strike signal; and a base power supply being coupled to said base panel, said base power supply being electrically coupled to said base control circuit, said base power supply comprising at least one battery.

6. The assembly according to claim 3, wherein:

each of said poles has a first end and a second end, said well in each of said remote and base targets insertably receiving said first end of a respective one of said poles; and each of said balls has an outer surface, said outer surface of each of said balls having a well extending inwardly therein, said well in each of said balls being directed upwardly when said balls are in said home position, said well in said outer surface of each of said balls insertably receiving said second end of said respective pole.

7. A sports training assembly having a plurality of sequentially illuminated targets for enhancing physical speed and reaction time, said assembly comprising:

a plurality of remote targets, each of said remote targets being positionable on a training field wherein each of said remote targets is configured to be struck by an athlete, said plurality of remote targets being spaced a pre-determined distance away from each other on the training field, each of said remote targets respectively emitting a visual alert when said respective remote target is turned on thereby establishing said respective remote target as the desired target for the athlete to strike, each of said remote targets comprising:

a remote panel having a primary surface and an outer edge, said outer edge having a lower side, said lower side having a well extending upwardly therein;

a remote control circuit being positioned within said remote panel;

a remote transceiver being positioned within said remote panel, said remote transceiver being electrically coupled to said remote control circuit, said remote transceiver emitting a trigger signal when said remote control circuit receives a trigger input, said remote control circuit being turned on when said remote transceiver receives an activation signal;

a plurality of remote light emitters, each of said remote light emitters being coupled to said primary surface of said remote panel, each of said remote light emitters being electrically coupled to said remote control circuit, each of said remote light emitters being turned on when said remote control circuit receives said activation signal from said remote transceiver wherein said remote light emitters are configured to visually alert the athlete to strike said remote panel;

a remote accelerometer being coupled to said first surface of said remote panel, said remote accelerometer detecting acceleration of said remote panel wherein said remote accelerometer is configured to detect when the athlete strikes said remote panel, said remote control circuit receiving said trigger signal when said remote accelerometer detects acceleration; and a remote power supply being coupled to said remote target, said remote power supply being electrically coupled to said remote control circuit, said remote power supply comprising at least one battery;

a base target being positionable on the training field wherein said base target is configured to be struck by the athlete, said base target emitting a visual alert when said base target is turned on thereby establishing said base target as the desired target for the athlete to strike, said base target being in electrical communication with each of said remote targets, said base target turning on each of said remote targets in a random sequence, said base target comprising:

a base panel having a first surface and a peripheral edge, said peripheral edge having a bottom side, said bottom side having a well extending upwardly therein;

a base control circuit being positioned within said base panel;

a base transceiver being positioned within said base panel, said base transceiver being electrically coupled to said base control circuit, said base transceiver being in wireless electrical communication with said remote transceiver in each of said remote targets, said base transceiver emitting said activation signal to said remote transceiver in a randomly selected remote target thereby turning on said remote control circuit in said randomly selected remote target, said base transceiver receiving said trigger signal from said remote transceiver in said randomly selected remote target when said remote accelerometer in said randomly selected remote target detects acceleration, said base control circuit randomly selecting a subsequent remote target when said base transceiver receives said trigger signal;

an electronic timer being positioned within said base panel, said electronic timer being electrically coupled to said base control circuit, said base transceiver emitting said activation signal after said electronic timer counts a pre-determined amount of time;

a control panel being coupled to said first surface of said base panel, said control panel being electrically coupled to said control circuit, said control panel being manipulated to select one of a plurality of pre-determined trigger times in said electronic timer;

a plurality of base light emitters, each of said base light emitters being coupled to said first surface of said base panel, each of said light emitters being electrically coupled to said base control circuit, each of said base light emitters being turned on when said base control circuit randomly selects said base target to be turned on wherein said base light emitters are configured to visually alert the athlete to strike said base panel;

a base accelerometer being coupled to said first surface of said base panel, said base accelerometer being electrically coupled to said base control circuit, said base accelerometer detecting acceleration of said base panel wherein said base accelerometer is configured to detect when the athlete strikes said base panel, said base control circuit receiving a strike input when said base accelerometer detects acceleration, said base control circuit randomly selecting a subsequent remote target when said base control circuit receives said strike signal; and a base power supply being coupled to said base panel, said base power supply being electrically coupled to said base control circuit, said base power supply comprising at least one battery;

a plurality of poles, each of said poles having a respective one of said remote or base targets being removably coupled thereto, each of said poles having a first end and a second end, said well in each of said remote and base targets insertably receiving said first end of a respective one of said poles; and a plurality of balls, each of said balls being internally weighted off center such that each of said balls is biased to return to a home position when said balls are rolled, each of said balls having a respective one of said poles being removably coupled thereto, each of said balls vertically orienting said respective pole when said balls are in said home position thereby elevating said remote and base targets for striking, each of said balls having an outer surface, said outer surface of each of said balls having a well extending inwardly therein, said well in each of said balls being directed upwardly when said balls are in said home position, said well in said outer surface of each of said balls insertably receiving said second end of said respective pole.

* * * * *